US006695650B2

(12) United States Patent
Mueller

(10) Patent No.: US 6,695,650 B2
(45) Date of Patent: Feb. 24, 2004

(54) PLUG-TYPE CONNECTOR FOR SIMULTANEOUSLY CONNECTING SEVERAL COAXIAL CABLES

(75) Inventor: Marcus Mueller, Sindelfingen (DE)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/198,253

(22) Filed: Jul. 18, 2002

(65) Prior Publication Data

US 2003/0109180 A1 Jun. 12, 2003

(30) Foreign Application Priority Data

Aug. 16, 2001 (DE) ..... 101 40 153

(51) Int. Cl.[7] ..... H01R 13/64

(52) U.S. Cl. ..... 439/680; 439/247; 439/248; 439/79

(58) Field of Search ..... 439/680, 246, 439/247, 248, 249, 79, 579, 564, 573

(56) References Cited

U.S. PATENT DOCUMENTS

| | | | | | |
|---|---|---|---|---|---|
| 3,673,545 | A | * | 6/1972 | Rundle | 439/248 |
| 5,067,908 | A | * | 11/1991 | Guth | 439/248 |
| 6,017,233 | A | * | 1/2000 | Fry et al. | 439/248 |
| 6,234,817 | B1 | * | 5/2001 | Hwang | 439/247 |
| 6,435,890 | B2 | * | 8/2002 | Kato et al. | 439/247 |

FOREIGN PATENT DOCUMENTS

| | | | | |
|---|---|---|---|---|
| DE | 35 36 142 | | 4/1987 | |
| EP | 0 345 934 | | 12/1989 | |
| EP | 0 232 288 | | 9/1991 | |
| EP | 0 547 970 | | 4/1995 | |
| EP | 0 430 107 | | 4/1996 | |
| EP | 0 722 202 | | 7/1996 | |
| EP | 0 907 223 | | 4/1999 | |
| JP | 4-26084 | * | 1/1992 | 439/246 |

* cited by examiner

*Primary Examiner*—Tho D. Ta

(57) ABSTRACT

The invention pertains to a plug-type connector for simultaneously connecting several coaxial cables, with said plug-type connector comprising a first plug part that is arranged on a first component and contains several first coupling elements in a first housing which are respectively connected to one of the coaxial cables, as well as a second plug part that is arranged on a second component and contains several second coupling elements in a second housing which are respectively connected to one of the coaxial cables. The two components can be separably connected to one another such that the plug parts become inserted into one another in a connecting direction. The movably supported housing contains the least one console that adjoins a first side of the corresponding component and on which a bearing journal is arranged, with said bearing journal extending through an oblong opening arranged in the corresponding component, and with the longitudinal direction of said oblong hole defining the first adjusting direction. The housing contains at least one holding-down appliance that is fixed on the bearing journal on the second side of the corresponding component which faces away from the console. The bearing journal protrudes from the oblong hole on the second side when the console adjoins the first side, namely such that the housing with its bearing journal can be displaced relative to the corresponding component in the oblong opening and said housing is supported on the corresponding component in such a way that it can also be moved in a second adjusting direction.

17 Claims, 5 Drawing Sheets

PLUG-TYPE CONNECTOR FOR SIMULTANEOUSLY CONNECTING SEVERAL COAXIAL CABLES

BACKGROUND OF THE INVENTION

The present invention pertains to a plug-type connector for simultaneously connecting several coaxial cables.

Plug-type connectors of this type are, for example, used in electronic apparatuses such as semiconductor testing devices in order to conductively connect coaxial cables installed in the apparatus to coaxial cables of a plug-in printed circuit board to be inserted into the apparatus. Such a plug-type connector usually comprises a first plug part that is mounted on one component (apparatus) and a second plug part that is realized complementary to the first plug part and mounted on the other component (plug-in printed circuit board). When connecting the two components to one another, the connection between the two plug parts is simultaneously produced.

In order to produce the connection, both components need to be moved toward one another in the inserting direction, wherein the plug parts must be aligned relative to one another so as to ensure that they can be properly inserted into one another. If the plug parts are not carefully aligned relative to one another during the connecting process, irreversible damages to the plug parts can occur relatively easily. In the above-mentioned application, one of the components consists, for example, of the main board of a semiconductor or processor testing device which is equipped with a series of receptacles for plug-in printed circuit boards. In a processor testing device, individual plug-in printed circuit boards need to be repeatedly removed, installed and exchanged such that the difficult connecting process described above needs to be carried out quite frequently.

EP 0 722 202 A2 discloses a plug-type connector in which the first plug part is equipped with a first coupling element for each coaxial cable. The second plug part is provided with a complementary second coupling element for each coaxial cable. An inner housing that carries one plug part is supported movably transverse to the inserting direction in an outer housing mounted on the assigned component. This plug-type connector simplifies the connecting process.

Plug-type connectors for different types of cables or optical fibers are known from EP 0 232 288 B1, DE 35 36 142 A1, EP 0 345 934 A2, EP 0 430 107 B1, EP 0 547 970 B1and EP 0 907 223 A2.

SUMMARY OF THE INVENTION

The present invention is based on the object of disclosing an improved variation of a plug-type connector of the initially described type in which, in particular, the risk of damaging the individual components during the connecting process is reduced.

This object is attained with the features of the independent claim. Advantageous embodiments are disclosed in the dependent claims.

According to the invention, at least one of the plug parts is supported on the corresponding component such that it is movable transverse to the connecting direction of the plug-type connector, namely in two adjusting directions that extend perpendicular to one another. Due to this design, the two complimentary plug parts can be aligned in a suitable relative position to one another much easier such that the risk of damages occurring during the connecting process is reduced.

In one advantageous embodiment, a positioning device is arranged on the housings, wherein said positioning device essentially aligns the housings of the plug parts congruently to one another referred to the first adjusting direction and/or the second adjusting direction when the two plug parts are connected to one another. Due to this positioning device arranged on the housings, the two plug parts practically are automatically aligned in the proper position when the two components are moved toward one another, i.e., when the person producing the connection moves one plug part toward the other plug part.

According to one additional development, the alignment between the two plug parts can be improved by providing one of the housings with a collar that protrudes in the inserting direction, wherein the other housing penetrates into said collar with lateral play when the plug parts are connected to one another. Due to this measure, the accuracy of the mutual alignment between the two plug parts is improved. In addition, this design ensures that the housings can only be inserted into one another if the coupling elements are at least roughly aligned coaxially to one another due to the alignment of the housings, wherein the collar simultaneously produces a parallel guide. The lateral play between the interconnected housings prevents the plug parts from becoming mutually jammed.

Another improvement is achieved due to the fact that the first coupling elements are held in the first housing with lateral play. Due to this measure, the assigned coupling elements can also be aligned relative to one another much easier during the connecting process. In addition, this movable holding arrangement prevents the first coupling elements from being bent as it may, for example, accidentally occur when improperly handling the first plug part. Manufacturing tolerances may also result in the individual coupling elements not being exactly aligned coaxially to one another even if the plug parts are optimally positioned. The mobility of the first coupling elements makes it possible to compensate these tolerances.

In order to effectively prevent an axial contact between the coupling elements during the connecting process, the second housing may be provided with a radially inward protruding step in front of each second coupling element viewed in the inserting direction, wherein said step radially overlaps a free edge of the receptacle sleeve opening of the second coupling element at least partially. The sensitive edge of the opening that, in particular, is acutely chamfered thusly is protected from becoming damaged.

In instances in which the two components consist, in particular, of an electronic apparatus, e.g., a semiconductor testing device, and a plug-in printed circuit board to be inserted therein, the two components, i.e., the apparatus and the plug-in printed circuit board, may contain at least one other plug-type connector for simultaneously connecting several single-conductor cables, wherein two complimentary plug parts of this other plug-type connector are positioned on these components, i.e., in the apparatus and on the plug-in printed circuit board, such that the plug parts for connecting the single-conductor cables are connected first, with the plug parts for connecting the coaxial cables subsequently being connected to one another. Due to this design, the plug-type connector for the single-conductor cables practically realizes a preliminary positioning of the two components such that the optimal positioning between the plug parts for connecting the coaxial cables is simplified. This embodiment is based on the notion that the plug-type connector for the single-conductor cables usually is constructed much more robust than the plug-type connector for the coaxial cables according to the invention. Consequently, the robust plug-type connector for the single-conductor cables usually is not damaged even if the connection is not properly produced. In any case, damages to the more sensitive plug-type connector for the coaxial cables are prevented.

Other important features and advantages of the device according to the invention are disclosed in the subclaims, the figures and the description of the corresponding figures.

BRIEF DESCRIPTION OF THE FIGURES

The invention is described in greater detail below with reference to the figures, wherein the same reference symbols refer to identical or functionally identical or similar characteristics. The schematic figures respectively show.

DETAILED DESCRIPTION OF THE FIGURES

Figure 1:
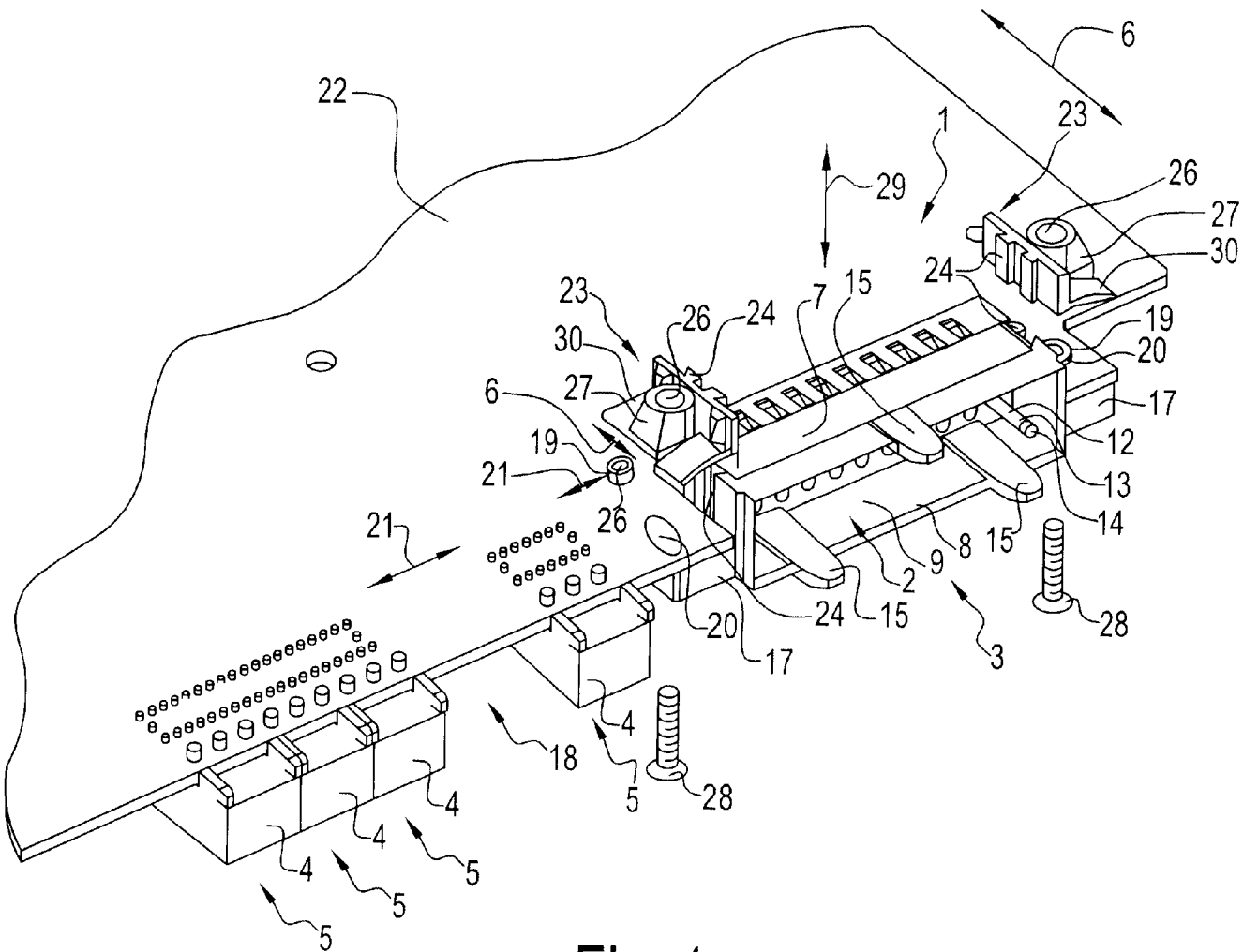
FIG. 1, a perspective representation of a first component that is equipped with a first plug part of the plug-type connector according to the invention, and FIGS. 2–5, perspective representations of a first plug part and a second plug part of the plug-type connector according to the invention, namely during different phases of the connecting process.

FIG. 1 shows an end section of a first component 1 that, according to one preferred application of the present invention, is realized in the form of a plug-in printed circuit board of an electronic apparatus, in particular, a semiconductor testing device. The first plug part 2 of the plug-type connector 3 according to the invention is arranged on one terminal edge of this component 1, wherein several coaxial cables 33 shown in FIGS. 2–5 should be simultaneously connected to one another with the aid of this plug part. The coaxial cables 33 consist of conventional coaxial cables with a central inner conductor and an outer conductor that surrounds the inner conductor. In coaxial cables of this type, an inside insulation is conventionally arranged between the inner conductor and the outer conductor, and an outside insulation is applied onto the outer conductor. The coaxial cables 33 are particularly well suited for transmitting high-frequency signals between the electronic equipment of the first component 1 and that of a second, not-shown component. The second component may, for example, consist of an electronic apparatus, in particular, a semiconductor testing device. In addition to the first plug part 2 of the plug-type connector 3 according to the invention, the first component 1 may also contain other plug parts 4 of conventional plug-type connectors 5 for simultaneously connecting single.

FIG. 1, a perspective partially exploded representation of a first component that is equipped with a first plug part of the plug-type connector according to the invention having a journal member being shown apart and a distance above from an oblong opening, and plug-type connector 3 according to the invention is symbolically indicated by an arrow 6 in FIG. 1.

The first plug part 2 of the plug-type connector 3 according to the invention comprises a housing 7, on which a closed peripheral collar 8 is arranged such that it protrudes forward in the connecting direction 6. This collar 8 surrounds a forwardly open shaft 9, into which a housing 10 of a second, complimentary plug part 11 shown in FIGS. 2–5 can be inserted. A first coupling element 12 for each coaxial cable 33 is arranged in the housing 7 or its shaft 9, respectively, wherein only one of these first coupling elements 12 is respectively illustrated in an exemplary fashion. Each first coupling element 12 comprises a cylindrical outer sleeve 13 of an electrically conductive material which is connected to the outer conductor of the corresponding coaxial cable. An inner sleeve that is not visible in the figure is coaxially arranged in the interior of the outer sleeve 13, with the inner sleeve also consisting of an electrically conductive material and being connected to the inner conductor of the corresponding coaxial cable. An insulation is usually arranged between the two sleeves. The free end of the first coupling element 12 is preferably provided with a rounded inserting contour 14 for simplifying the connecting process.

Several tabs 15 that protrude over the collar 8 in the connecting direction 6 are also arranged on the first housing 7. In this case, the tabs 15 form part of a positioning device 16 that is described in greater detail below with reference to FIGS. 2–5.

One respective laterally protruding console 17 is arranged on the first housing 7 on two opposite sides of the first housing 7, wherein said console 17 contains a contact surface on the side that faces the first component 1. This contact surface of the console 17 contacts the first component 1 on a first side 18 of the first component 1 which faces away from the observer. Each console 17 preferably contains a cylindrical bearing journal 19 that perpendicularly protrudes from the console 17 or its contact surface, respectively. An oblong hole 20 is provided for each bearing journal 19 in the first component 1, wherein the corresponding bearing journal 19 extends through the assigned oblong hole 20. The longitudinal direction of the oblong holes 20 defines a first adjusting direction 21 that is symbolized by a double arrow and extends perpendicular to the connecting direction 6. In addition, the first adjusting direction 21 extends in the plane of the first component 1 in this case. On a second side 22 of the first component 1 which faces the observer, the first housing 7 contains a holding-down appliance 23 for each console 17, wherein the holding-down appliance 23 is mounted on the first housing 7 in such a way that the first housing 7 is securely held on the first component 1 and its bearing journals 19 are supported in the oblong holes 20, namely such that it can be displaced or moved relative to the first component 1 in the first adjusting direction 21.

In the preferred embodiment shown, each holding-down appliance 23 is connected to the first housing 7 by means of a guide profile 24, wherein a guiding direction of this guide profile 24 extends transverse to the first adjusting direction 21 and transverse to the connecting direction 6. The guide profile 24 that, for example, is realized in the form of a dovetail coupling rigidly holds the holding-down appliance 23 on the housing 7 transverse to the guiding direction. The assembly of the first plug part 2 is simplified due to this arrangement of the holding-down appliance 23 on the first housing 7.

The axial length of the bearing journal 19 is chosen longer than the thickness of the first component 1 within the region of the corresponding oblong hole 20 in the preferred embodiment shown. This means that the bearing journal 19 protrudes from the oblong hole 20 on the second side 22 of the first component 1 when the console 17 adjoins the first side 18 of the first component 1. Each bearing journal 19 and the corresponding console 17 are screwed together by means of a screw 28 in order to fasten the first housing 7, wherein the central part 27 and the bearing journal 19 are braced relative to one another. Due to the aforementioned dimensions of the bearing journal 19, this fastening results in a certain play transverse to the first adjusting direction 21 and transverse to the connecting direction 6. This play defines the second adjusting direction that is symbolized by a double arrow 29. This means that the first housing 7 is also supported on the first component 1 such that it can be displaced or moved relative to the first component 1 in this second adjusting direction 29. The second adjusting direction 29 extends perpendicular to the first adjusting direction 21 and perpendicular to the connecting direction 6 in this case.

In the embodiment shown, each holding-down appliance 23 contains two spring elements 30 that are supported on the second side 22 of the first component 1 and thusly produce a prestressed contact between the console 17 and the first side 18 of the first component 1. In this case, the mobility of the first housing 7 in the second adjusting direction 29 is preserved.

According to FIG. 1, another peculiarity can be seen in the fact that the first plug part 2 of the plug-type connector 3 according to the invention for coaxial cables 33 is fixed on the same side as the plug parts 4 of the conventional plug-type connector 5 for the single-conductor cables, namely on the first side 18 that faces away from the observer. Due to this arrangement, fluctuations in the thickness of the first component 1 due to manufacturing tolerances have the same effect on both plug connections 3 and 5, i.e., the relative position between the first plug part 7 and the plug parts 4 of the plug-type connectors 3 and 5 are not dependent on the thickness of the first component 1.

According to FIGS. 2–5, the positioning device 16 contains a tab receptacle 31 for each tab 15 on the second housing 10. The tabs 15 and the corresponding tab receptacles 31 cooperate during the connecting process shown in FIGS. 2–5 in order to align the housings 7 and 10. For this purpose, suitable inserting contours 32 are provided on the tabs 15 and on the tab receptacles 31, wherein said inserting contours cooperate in such a way that the two housings 7 and 10 are aligned referred to the first adjusting direction 21 and the second adjusting direction 29. In this case, the two housings 7 and 10 are, after being aligned, essentially situated congruently to one another such that the second housing 10 can be inserted into the shaft 9 of the first housing 7.

The second housing 10 contains a second coupling element 34 for each coaxial cable 33, wherein said coupling element is realized complementary to the corresponding first coupling element 12. In this case, only one of the second coupling elements 34 is illustrated in an exemplary fashion. Each second coupling element 34 contains a receptacle sleeve 35, into which the outer sleeve 13 of the first coupling element 12 can be inserted in order to produce an electrically conductive connection. The inside of the second coupling element 34 contains a central pin 36 that is arranged coaxial to the receptacle sleeve 35 and can be inserted into the inner sleeve of the first coupling element 12 in order to produce an electrically conductive connection. The receptacle sleeve 35 is connected to the outer conductor of the corresponding coaxial cables 33, and the pin 36 is connected to the inner conductor of the coaxial cable 33. The outer sleeve 35 this slotted on its free end such that radially springable end sections 37 are formed in order to improve the contact. A chamfer 38 may also be arranged on the free edge of the opening of the receptacle sleeve 35, wherein said chamfer 38 is acutely tapered radially outward.

Figure 2:
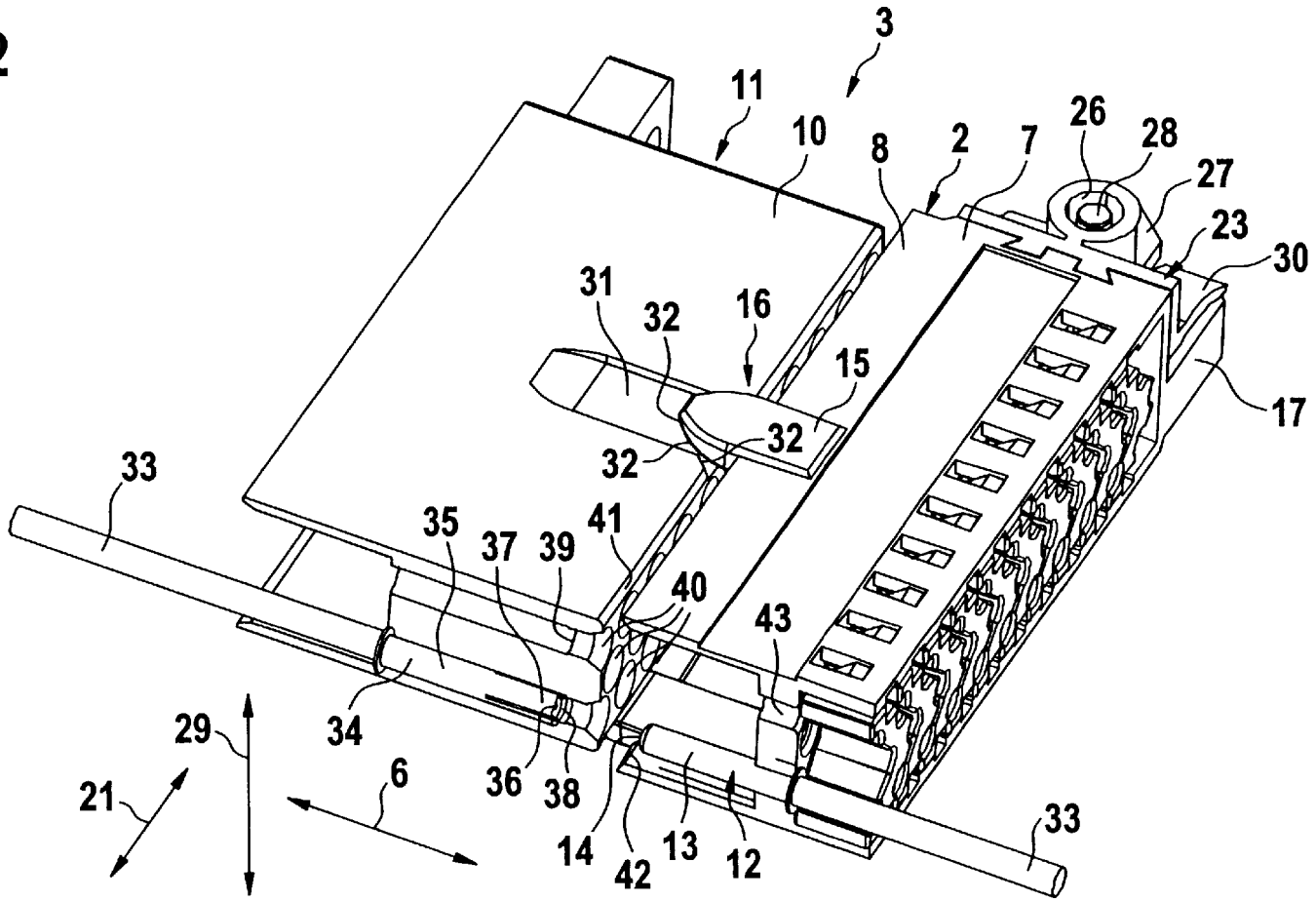

An annular step 39 is formed in the second housing 10 in front of each second coupling element 34 viewed in the connecting direction 6, wherein said step protrudes radially inward and radially extends over the free edge of the opening of the receptacle sleeve 30 at least to such a degree that the acute, chamfered edge of the opening is radially overlapped. In addition, the second housing 10 contains an inserting funnel 40 in front of each second coupling element 34 viewed in the connecting direction 6, wherein said The connection of the plug-type connector 3 according to the invention is essentially produced as described below:

The component 1 that is equipped with the first plug part 2 is moved toward the not-shown second component equipped with the second plug part 11. A rough positioning between the two plug parts 2 and 11 can advantageously be achieved by arranging the plug-type connector 3 according to the invention for the coaxial cables 33 further toward the rear than the conventional plug-type connectors 5 for the single-conductor cables viewed in the connecting direction 6. Accordingly, the plug parts 4 of these conventional plug-type connectors 5 for single-conductor cables contact their complementary counterparts earlier than the first plug part 7 of the plug-type connector 3 according to the invention. After this preliminary positioning, the phase shown in FIG. 2 is reached, wherein the tabs 15 do not yet cooperate with their corresponding tab receptacles 31. During the continued connecting movement, the inserting contours 32 of the tabs 15 and the tab receptacles 31 are able to corporate in order to congruently align the two housings 7 and 10. The positioning device 16 causes an inevitable adjustment of the first housing 7 relative to the second housing 10, wherein said adjustment is possible due to the fact that the first housing 7 can be adjusted relative to the first component 1 in the first adjusting direction 21 and in the second adjusting direction 29.

The positioning device 16 is adapted to the collar 8 of the first housing 7 in such a way that the aligned relative position between the housings 7 and 10 is already reached before the second housing 10 penetrates into the shaft 9, i.e., into the collar 8 of the first housing 7. In order to simplify the penetration of the second housing 10 into the collar 8 of the first housing 7, the dimensions of the second housing 10 are adapted to the dimensions of the shaft 9 in such a way that a lateral play which, however, may be relatively small is achieved. In addition, the collar 8 and/or the second housing 10 may be equipped with inserting bevels 41 and 42 in order to simplify the penetration of the second housing 10 into the shaft 9.

Figure 3:
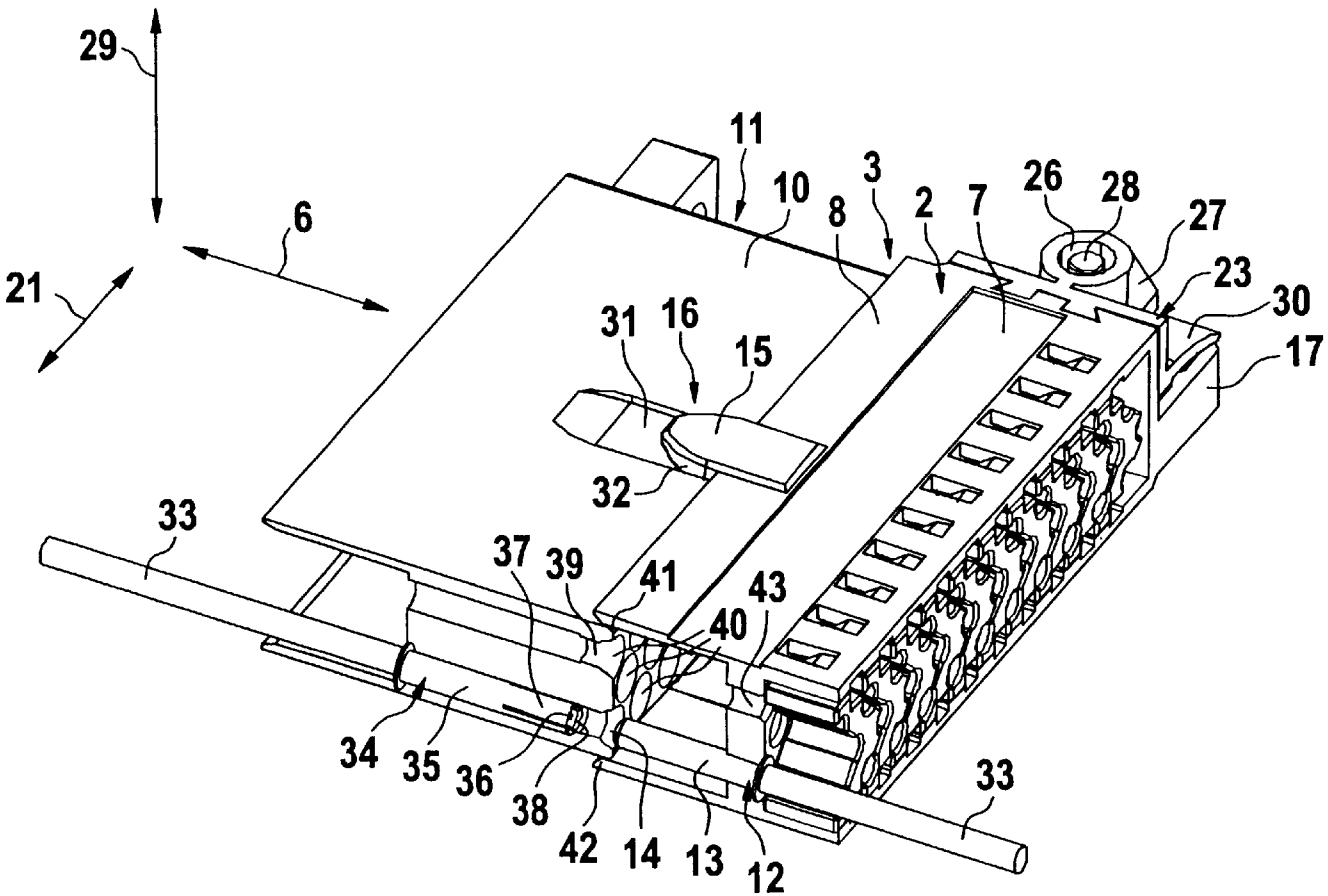

FIG. 3 shows the relative position during a second phase in which the two housings 7 and 10 essentially are congruently aligned relative to one another by the positioning device 16. In this case, the second housing 10 already has penetrated slightly into the shaft 9 of the first housing 7. The dimensions of the collar 8 are chosen in such a way that the first coupling elements 12 have not yet penetrated into the corresponding inserting funnels 40 in this second phase. Due to this design, a rough positioning of the coupling elements 12 and 34 is achieved. During the continued connecting movement, the first coupling elements 12 penetrate into the inserting funnels 40 such that the coupling elements 12 and 34 are precisely aligned. For this purpose, the first coupling elements 12 preferably are held in the first housing 7 such that they can be laterally moved. For example, the openings 43 in which the first coupling elements 12 are held on the first housing 7 have a certain play such that the first coupling elements 12 are able to carry out tumbling movements relative to the respective opening 43.

Figure 4:
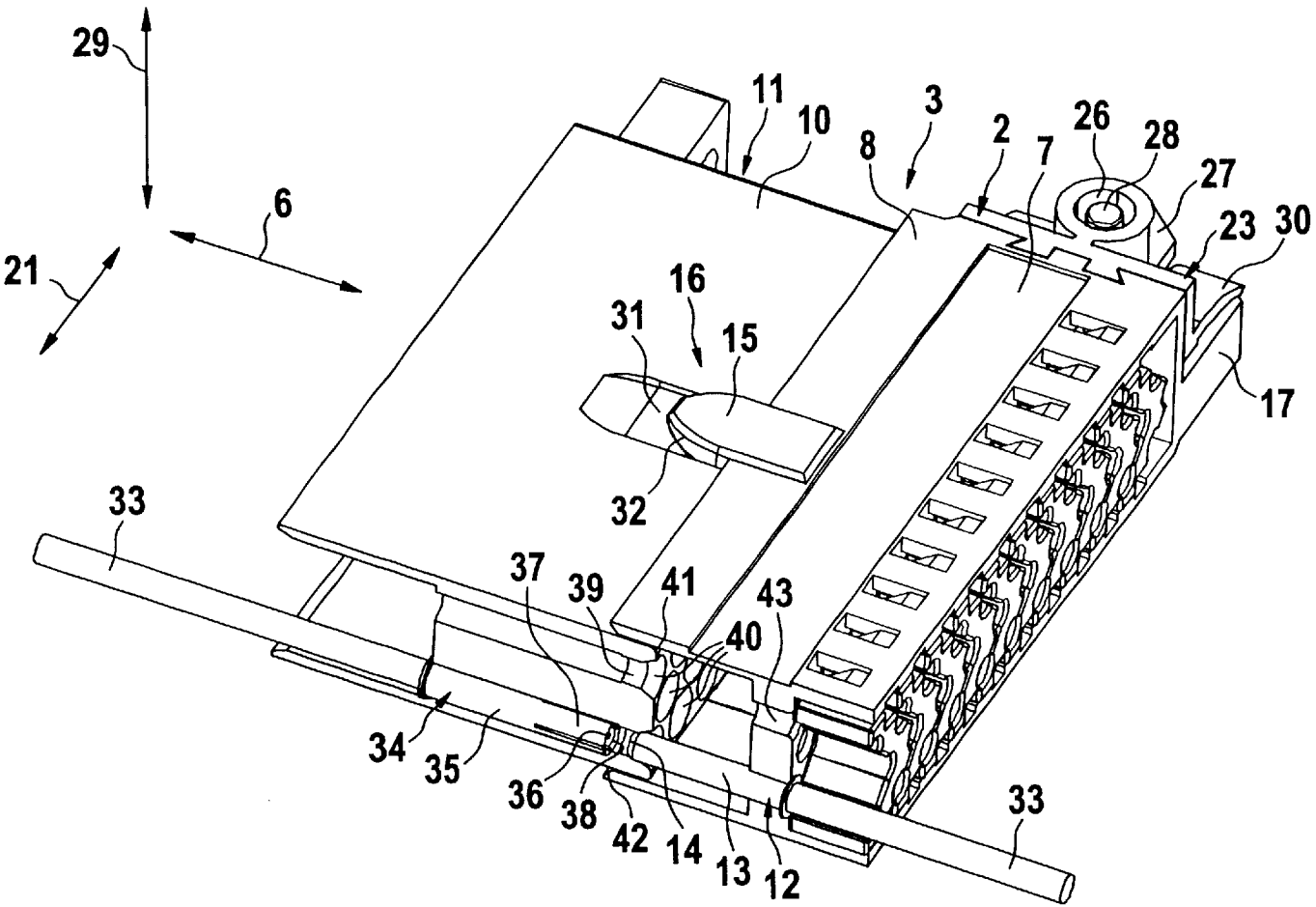

FIG. 4 shows the third phase of the connecting movement, wherein it is clear that the positions of the coupling elements 12 and 34 are adapted to one another in such a way that the first coupling element 12 is coaxially aligned relative to the corresponding second coupling element 34 in a quite precise fashion by the corresponding inserting funnel 40 during the connecting process, namely even before the coupling elements 12 and 34 contact one another. As the connecting movement continues, the outer sleeve 13 of the first coupling element 12 is able to penetrate into the receptacle sleeve 35 of the second coupling element 34 without risking that the first coupling element 12 axially contacts the sensitive free edge of the opening of the second coupling element 35, namely because the step 39 prevents the free ends of the two coupling elements 12 and 34 from axially contacting one another.

Figure 5:
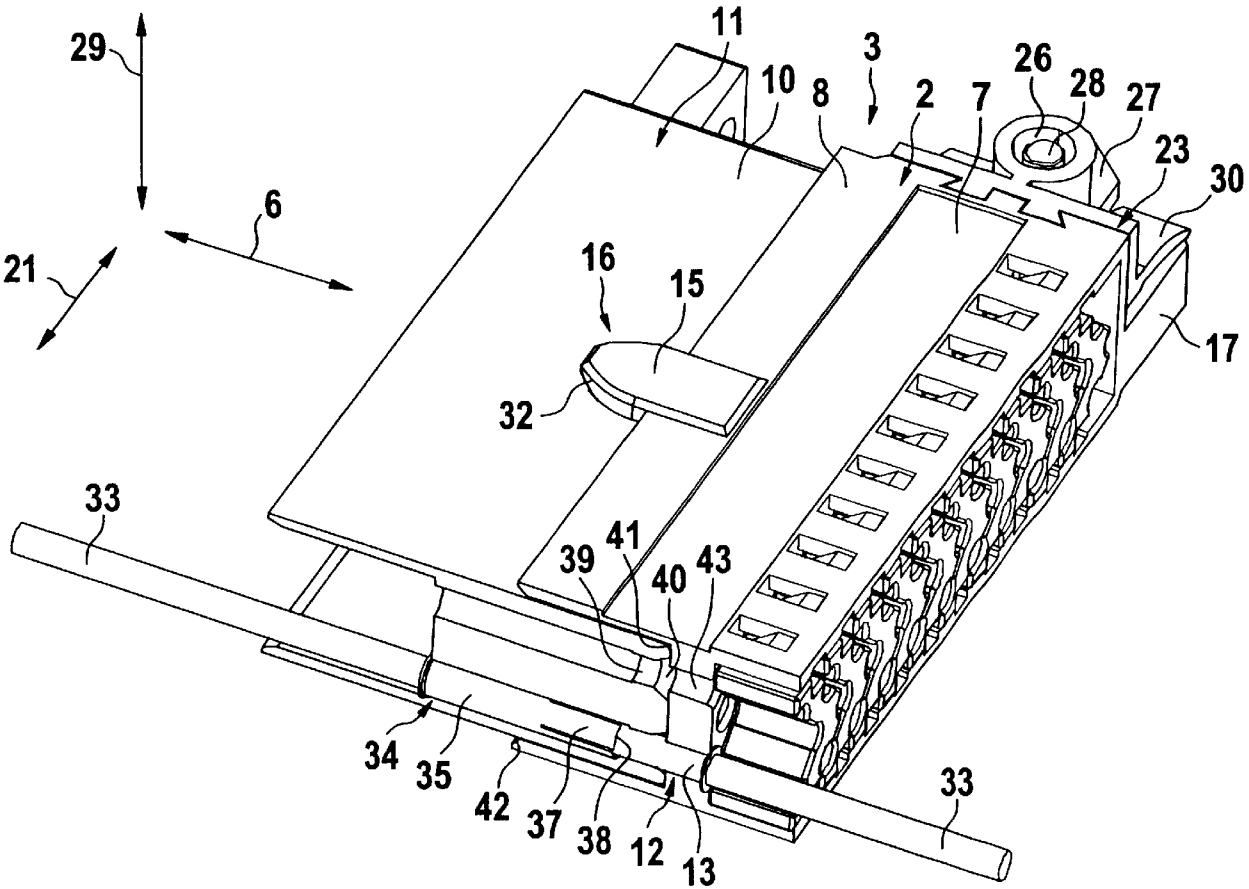

FIG. 5 shows the end phase or end position of the connecting movement; the respective first coupling elements 12 are now properly connected to the corresponding second coupling elements 34.

What is claimed is:

1. Plug-type connector for simultaneously connecting several coaxial cables, comprising:

a first plug part that is arranged on a first component and contains several first coupling elements in a first housing which are respectively connected to one of the coaxial cables, a second plug part that is arranged on a second component and contains several second coupling elements in a second housing which are respectively connected to one of the coaxial cables, wherein the first and the second coupling elements are realized complementary such that they can be inserted into one another, wherein the two components can be separably connected to one another by inserting the plug parts into one another in a connecting direction when connecting the components, wherein at least one of the housings is supported on the corresponding component such that it can be moved in a first adjusting direction that extends transverse to the connecting direction, wherein the movably supported housing contains at least one console that adjoins a first side of the corresponding component and on which a bearing journal is arranged, with said bearing journal extending through an oblong opening arranged in the corresponding component, and with the longitudinal direction of said oblong opening defining the first adjusting direction, wherein the housing contains at least one holding-down appliance that is fixed on the bearing journal on the second side of the corresponding component which faces away from the console, and wherein the bearing journal protrudes from the oblong opening on the second side when the console adjoins the first side, namely such that the housing with its bearing journal can be displaced relative to the oblong opening and the housing is supported on the corresponding component in such a way that it can also be moved in a second adjusting direction that extends transverse to the connecting direction and transverse to the first adjusting direction.

2. Plug-type connector according to claim 1, wherein the holding-down appliance is connected to the housing by means of a guide profile, the guiding direction of which extends transverse to the first adjusting direction and transverse to the connecting direction, with the guide profile rigidly holding the holding-down appliance on the housing transverse to the guiding direction.

3. Plug-type connector according to claim 1, wherein one of the housings contains a collar that protrudes in the connecting direction, with the other housing penetrating into said collar with lateral play when connecting the plug parts.

4. Plug-type connector according to claim 1, wherein a positioning device is formed on the housings, with the positioning device essentially aligning the housings of the plug parts congruently to one another referred to the first adjusting direction that extends transverse to the connecting direction and/or referred to the second adjusting direction that extends transverse to the first adjusting direction and transverse to the connecting direction when connecting the plug parts, wherein one of the housings contains a collar that protrudes in the connecting direction, with the other housing penetrating into said collar with lateral play when connecting the plug parts, and wherein the collar and the positioning device are adapted to one another in such a way that the other housing only penetrates into the collar of the housing after the alignment.

5. Plug-type connector according to claim 1, wherein the first coupling elements are held in the first housing with lateral play.

6. Plug-type connector according to claim 1, wherein the second housing contains a radially inward protruding step in front of each second coupling element viewed in the connecting direction, with said step radially overlapping the free edge of the opening of the receptacle sleeve at least partially.

7. Plug-type connector according to claim 1, wherein one component consists of an electronic apparatus, into which the other component that is realized in the form of a plug-in printed circuit board is inserted in order to produce a separable connection.

8. Plug-type connector according to claim 1, wherein the two components contain at least one other plug-type connector for simultaneously connecting several single-conductor cables, with two complimentary plug parts of this other plug-type connector being positioned on the components in such a way that, when connecting the components, the plug parts of the plug-type connector for the single-conductor cables are connected first, and with the plug parts of the plug-type connector for the coaxial cables subsequently being connected to one another.

9. Plug-type connector according to claim 1, wherein both components contain at least one other plug-type connector for simultaneously connecting several single-conductor cables, with a plug part of this other plug-type connector which is arranged on the first component being fixed on the same side of the first component as the first housing of the first plug part of the plug-type connector for the coaxial cables.

10. Plug-type connector according to claim 1, wherein spring elements are formed on the holding-down appliance, with said spring elements supporting the movable housing on the second side of the corresponding component.

11. Plug-type connector according to claim 10, wherein the spring elements are elastically springable in the second adjusting direction and prestress the console against the first side of the corresponding component in the second adjusting direction.

12. Plug-type connector according to claim 1, wherein a positioning device is formed on the housings, with the positioning device essentially aligning the housings of the plug parts congruently to one another referred to the first adjusting direction that extends transverse to the connecting direction and/or referred to the second adjusting direction that extends transverse to the first adjusting direction and transverse to the connecting direction when connecting the plug parts.

13. Plug-type connector according to claim 12, wherein the positioning device comprises at least one tab arranged on one housing and a tab receptacle arranged on the other housing, with the tab and the tab receptacle containing inserting contours that corporate with one another when connecting the plug parts in order to align the housings.

14. Plug-type connector according to claim 1, wherein the second housing contains an inserting funnel in front of each second coupling element viewed in the connecting direction.

15. Plug-type connector according to claim 1, wherein one of the housings contains a collar that protrudes in the connecting direction, with the other housing penetrating into said collar with lateral play when connecting the plug parts, wherein the second housing contains an inserting funnel in front of each second coupling element viewed in the connecting direction, and wherein the collar and the inserting funnel are adapted to one another in such a way that the other housing penetrates into the collar of the housing before the first coupling elements penetrate into the inserting funnels.

16. Plug-type connector according to claim 14 or 15, wherein the positions of the first coupling elements and the second coupling elements are adapted to one another in such a way that each first coupling element essentially is aligned coaxially to the corresponding second coupling element by the respective inserting funnel when the plug parts are connected to one another, namely before the first coupling element penetrates into the second coupling element.

17. Plug part for a plug-type connector for simultaneously connecting several coaxial cables, comprising:

a housing that contains several coupling elements that can be respectively connected to one coaxial cable, wherein the housing contains the least one console that is able to adjoin a first side of the component and on which a bearing journal is arranged, with said bearing journal extending through an oblong opening arranged in the component, and with the longitudinal direction of said oblong hole defining the first adjusting direction, wherein the housing contains at least one holding-down appliance that is fixed on the bearing journal on the second side of the component which faces away from the console, and wherein the bearing journal protrudes from the oblong hole on the second side when the console adjoins the first side, namely such that the housing with its bearing journal can be displaced relative to the oblong opening and said housing is supported on the corresponding component in such a way that it can be moved in a second adjusting direction that extends transverse to the connecting direction of the plug part and transverse to the first adjusting direction.

* * * * *